US008739577B2

(12) United States Patent
Kwak et al.

(10) Patent No.: US 8,739,577 B2
(45) Date of Patent: Jun. 3, 2014

(54) WASHING MACHINE

(75) Inventors: Dae Wook Kwak, Gyeongsangnam-do (KR); Jong Min Kim, Gyeongsangnam-do (KR); Cheol Kang Heo, Gyeongsangnam-do (KR); Han Ki Cho, Gyeongsangnam-do (KR); Gyung Hun Nho, Gyeongsangnam-do (KR); Soon Jo Lee, Gyeongsangnam-do (KR); Kyu Chul Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 313 days.

(21) Appl. No.: 13/321,570

(22) PCT Filed: Jul. 30, 2010

(86) PCT No.: PCT/KR2010/005025

§ 371 (c)(1),
(2), (4) Date: Nov. 21, 2011

(87) PCT Pub. No.: WO2011/014032

PCT Pub. Date: Feb. 3, 2011

(65) Prior Publication Data

US 2012/0060565 A1 Mar. 15, 2012

(30) Foreign Application Priority Data

Jul. 31, 2009 (KR) ..... 10-2009-0070756
Jul. 31, 2009 (KR) ..... 10-2009-0070757

(51) Int. Cl.
*D06F 25/00* (2006.01)

(52) U.S. Cl.
USPC ..... 68/13 R; 68/20; 68/17 R; 68/19.2; 68/23 R; 68/5 C; 34/596; 34/75; 34/402; 34/565

(58) Field of Classification Search
CPC ..... D06F 37/26; D06F 37/267; D06F 25/00; D06F 37/00; D06F 39/00; D06F 39/081; D06F 58/24
USPC ... 68/20, 13 R, 19.2, 208, 23 R, 5 C, 5 R, 24; 134/99.1, 102.1, 102.2, 102.3, 105; 8/137, 159, 149.3, 158, 142; 137/14, 137/391, 408, 511, 528, 597
See application file for complete search history.

(56) References Cited

U.S. PATENT DOCUMENTS 3,035,429 A * 5/1962 Smith et al. ..... 68/20
7,634,925 B2 12/2009 Lim (Continued)

FOREIGN PATENT DOCUMENTS

CN 1844548 A 10/2006
EP 1666565 A1 6/2006
EP 1 710 339 A1 10/2006

OTHER PUBLICATIONS

PCT International Search Report dated Feb. 25, 2011, for Application No. PCT/KR2010/005025, 2 pages.

(Continued)

*Primary Examiner* — Michael Barr
*Assistant Examiner* — Thomas Bucci
(74) *Attorney, Agent, or Firm* — Fish & Richardson P.C.

(57) ABSTRACT

A washing machine is disclosed. A washing machine includes a cabinet configured to define an exterior appearance thereof; a tub installed in the cabinet to hold wash water therein; a drum rotatably installed in the tub to accommodate laundry therein; at least one venting portion provided in an upper portion of the tub to communicate with an outside of the tub; and a ventilation part (300) provided in a lower portion of the tub to communicate with an inside of the tub. The above configuration enables convection current of internal air of the tub generated via the venting portion and the ventilation part (300).

19 Claims, 6 Drawing Sheets

(56) References Cited

U.S. PATENT DOCUMENTS

| | | | | |
|---|---|---|---|---|
| 2004/0194514 | A1* | 10/2004 | No et al. | 68/24 |
| 2006/0117808 | A1* | 6/2006 | Oh et al. | 68/3 R |
| 2006/0225467 | A1 | 10/2006 | Lim | |
| 2008/0178376 | A1* | 7/2008 | Seibt et al. | 4/301 |
| 2011/0296879 | A1* | 12/2011 | Seo et al. | 68/23 R |

OTHER PUBLICATIONS

Supplementary European Search Report mailed Mar. 25, 2013 for corresponding EP Application No. 10804745.7 (4 pages).

Chinese Office Action dated Nov. 29, 2013 for Application No. 201080025656.9 with English Translation, 10 pages.

* cited by examiner

WASHING MACHINE

TECHNICAL FIELD

The present invention relates to a washing machine, more specifically, to a washing machine having improved air permeability.

BACKGROUND ART

Generally, a washing machine may be categorized into a top loading type and a front loading type, based on laundry loading.

Top loading type washing machine may be categorized into a drum type washing machine having a rotatable drum in washing and rinsing processes, a pulsator type washing machine having a pulsator rotatable in a drum and a combined type washing machine having a rotatable drum and a rotatable pulsator.

A rotatable drum type washing machine out of top/front loading type washing machines has less laundry abrasion and less water usage than a pulsator type washing machine advantageously.

According to such the drum type washing machine, a drum is rotatably mounted in a tub configured to hold wash water and wash water is supplied to the drum to be drained outside via a predetermined portion of the tub.

DISCLOSURE OF INVENTION

Technical Problem

However, humidity or wash water happens to remain in an inside of such the conventional drum type washing machine partially. If the wash water remains, the inside of the drum would be kept humid and an unpleasant smell might be generated.

Because of that, an air communication structure is required by the conventional drum type washing machine. The air communication structure is configured to communicate the tub and the cabinet and it secures air permeability to improve unpleasant smell exhaustion and ventilation function when the washing machine is not used.

In addition, if such the air communication structure is in an open state, bubbles of detergent might be exhausted outside the tub during a washing process and a predetermined structure configured to prevent that is required accordingly.

Solution to Problem

An object of the present invention is to provide a washing machine which can secure air permeability when not used.

Another object of the present invention is to provide a washing machine which can prevent detergent bubbles from escaping a tub provided therein.

To achieve these objects and other advantages and in accordance with the purpose of the invention, as embodied and broadly described herein, a washing machine includes a cabinet configured to define an exterior appearance thereof: a tub installed in the cabinet to hold wash water therein; a drum rotatably installed in the tub to accommodate laundry therein; at least one venting portion provided in an upper portion of the tub to communicate with an outside of the tub; and a ventilation part provided in a lower portion of the tub to communicate with an inside of the tub, and wherein a convection current of internal air of the tub generated via the venting portion and the ventilation part.

External air of the tub may be drawn into the tub via the ventilation part, the external air of the tub having a relatively lower temperature than the internal air, and internal air of the tub may be discharged out of the tub via the venting portion, the internal air of the tub having a relatively higher temperature than the external air.

An end of the ventilation part may be in communication with a rear lower portion of the tub and the other end thereof may be extended toward a top of the cabinet from the tub.

The ventilation part may have a pipe shape and a predetermined portion of the extended part of the ventilation may be bent.

The ventilation part may be one-sidedly in a rear portion of the tub.

An end portion of the ventilation part, which is extended toward an upper part of the cabinet, may be higher than a predetermined water level measured when the maximum amount of the wash water is held in the tub.

The ventilation part may include a plurality of coupling parts so that the ventilation part is coupled to the cabinet.

The venting portion or the ventilation part may include a check valve.

The ventilation part may include a valve supporting part so that the check valve is supported and installed therein.

The check valve may include a flapper and a flapper supporting part is provided with the flapper as one body.

The flapper supporting part may include a hooking projection hooked to the valve supporting part and a flexible projection spaced apart a predetermine distance from the hooking projection, the flexible projection elastically transformable.

The width (L2) between ends of the hooking projection and the flexible projection may be larger than the width (L1) of the flapper.

The ventilation part may further include a damper part so as to dampen an operational shock during the operation of the flapper.

The damper part may be provided between contacting surfaces of the flapper and the valve supporting part.

The damper part may include a plurality of coupling projections so that the damper part is coupled to the ventilation part.

The damper part may be made of elastic material.

The ventilation part may further include a bubble receiver which receives detergent bubbles discharged via the check valve.

The bubble receiver may be integrally formed with or separable from an end of the ventilation part.

Advantageous Effects of Invention

The present invention has following advantageous effects.

As described above, the washing machine according to the embodiment of the present invention can prevent detergent bubbles from exhausting outside the tub.

Furthermore, the washing machine according to the embodiment of the present invention has an effect of improved smell exhaustion and ventilation function.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

As follows, a drum type washing machine may be embodied as an exemplary embodiment and a washing machine according to the present invention will be described in reference to the accompanying drawings. Here, the present invention may be applicable to a drum type washing machine including a direct-connection type drum washing machine including a tub directly connected to at least one of front, rear and side parts of a cabinet, without any limitation.

Figure 1:
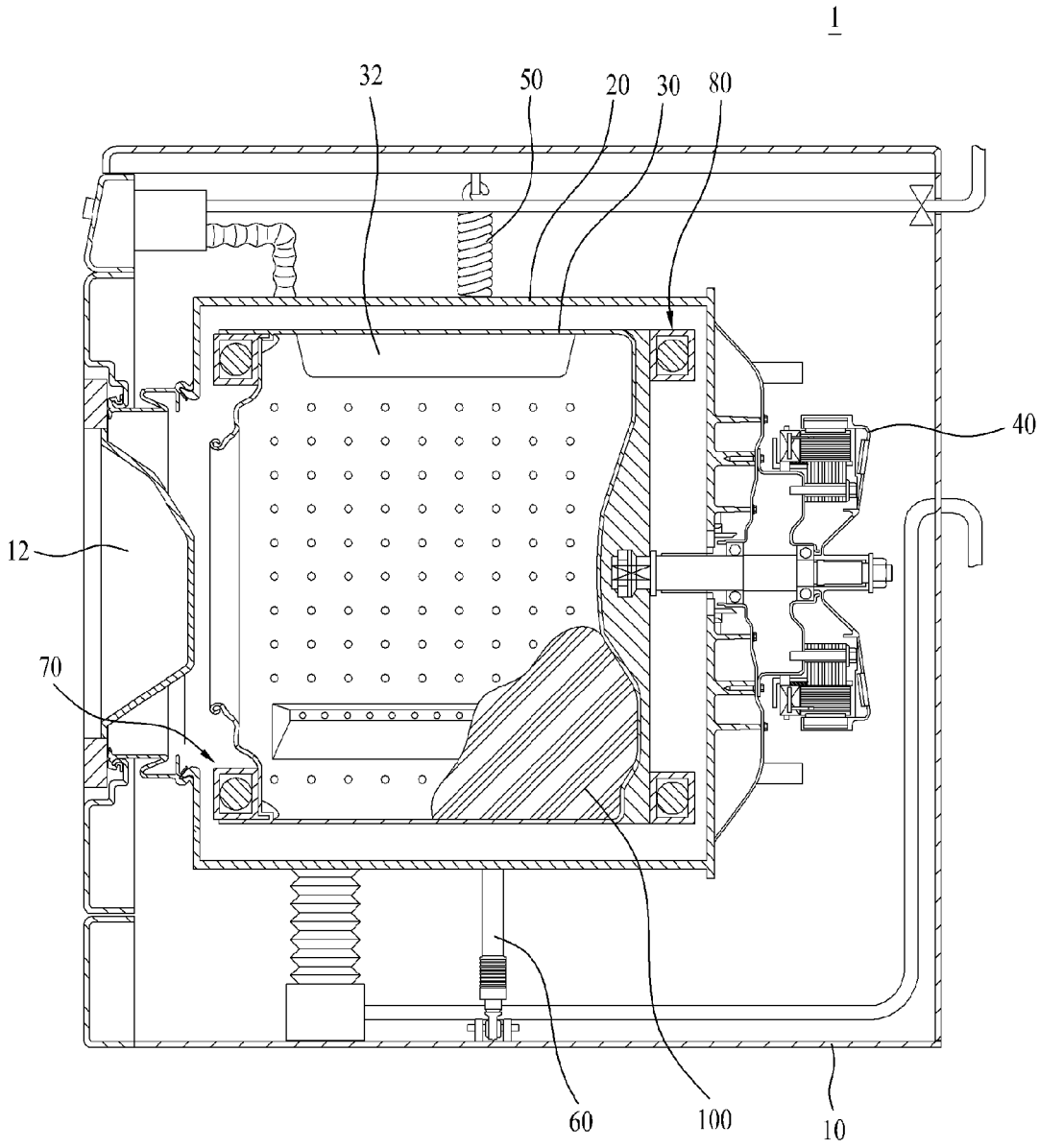
FIG. 1 is a sectional view illustrating a washing machine according to an exemplary embodiment of the present invention.

In reference to FIG. 1, a typical configuration of a washing machine according to an exemplary embodiment of the present invention will be described.

The washing machine 1 according to the exemplary embodiment of the present invention includes a cabinet 10 configured to define an exterior appearance thereof, a tub 20 installed in the cabinet 10 to hold wash water therein and a drum 30 rotatably mounted in the tub 20 to accommodate laundry 100 therein.

A door 12 is coupled to a front part of the cabinet 10 and the door 12 enables the laundry loaded into the drum 20.

The tub 20 may be flexibly supported by a spring 50 provided beyond the tub 20 and a damper 60 provided below the tub 20. When the drum 30 is rotated, the spring 50 and the damper 60 absorb vibration of the drum 30 not to transmit the vibration to the cabinet 10. A driving part 40 is installed in a rear surface of the tub 20 and the driving part 40 is configured to drive the drum 30.

A plurality of lifters 32 may be provided in the drum and the lifters 32 drops and drops the laundry during the rotation of the drum. A balancer 70 and 80 may be provided in a front surface and/or rear surface of the drum 30 and the balancer 70 and 80 configured for balancing to suppress the vibration of the drum 30.

The washing machine 1 treats the laundry 100 through washing, rinsing and spinning processes by using wash water supplied by an external water supply source.

Once the wash water is drained after the treating process, humidity or water remnants happens to remain in the washing machine. Such the water remnants might generate unpleasant smell because the inside of the drum 30 is kept humid.

As a result, it is required to secure air permeability when the washing machine 1 is not used. In case a structure configured to secure such the air permeability is in an open state, detergent bubbles and the like would be exhausted outside the tub 20 and a predetermined structure has to be provided to prevent the bubble exhaustion.

As follows, the air permeability securing and the bubble exhaustion preventing structure will be described in reference to the drawings.

Figure 2:
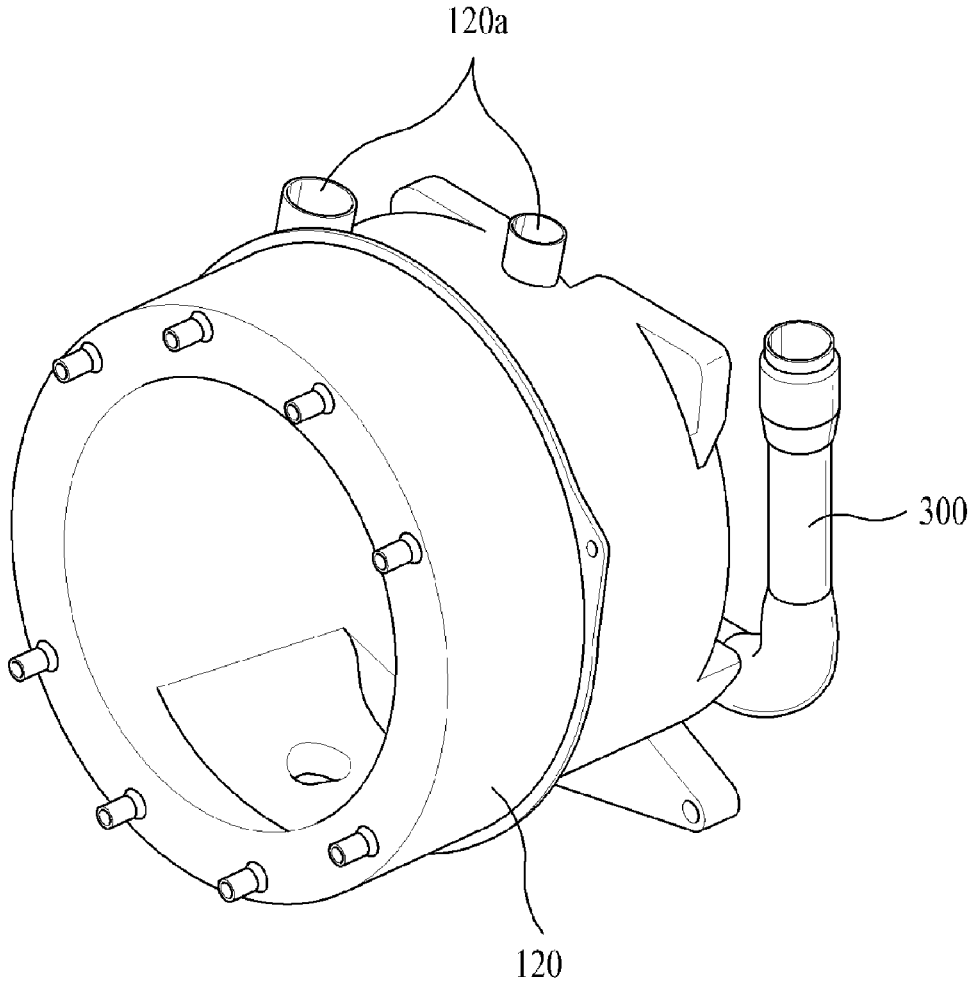
FIG. 2 is a perspective view illustrating a ventilation part installed in the washing machine shown in FIG. 1.

As shown in FIG. 2, a venting portion 120*a* and a ventilation part 300 may be provided in the tub 20 to improve air permeability by way of convection currents.

The venting portion 120*a* is configured to communicate an outside of the tub 20 with an inside and it is a cylindrical shape, projected from the tub 20. The venting portion 120*a* may be provided in a rear upper portion or a rear side portion of the tub 20 and at least one venting portion 120*a* may be provided, not limited thereto. A plurality of venting portions may be provided and the embodiment presents two venting portions.

Figure 3:
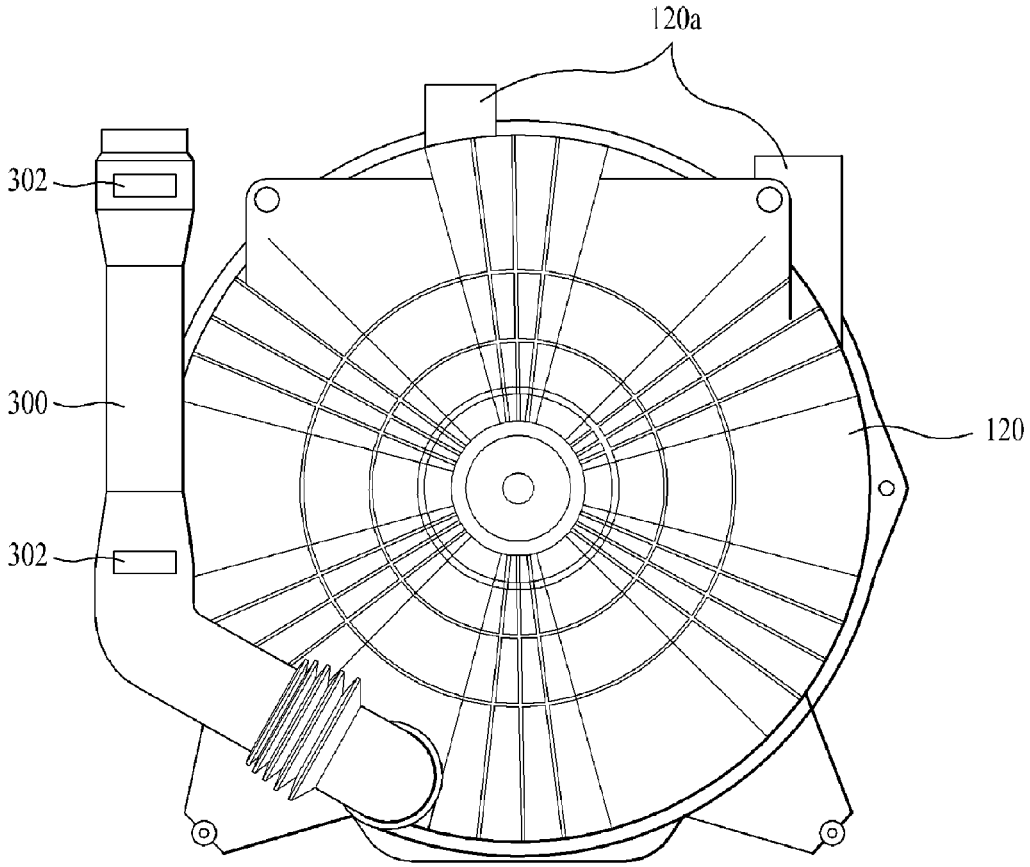
FIG. 3 is a rear view illustrating the installation state of the ventilation part shown in FIG. 2.

As shown in FIG. 3, the ventilation part 300 may be provided in rear of the tub 20 and it is a pipe shape, having an end in communication with a rear lower portion of the tub 20 and the other end extended upward toward a top of the cabinet 10. The ventilation part 300 includes a predetermined portion of an extended part which is bent not to interfere with structures located near the ventilation part 300, and it may be located in one rear sided-portion of the tub 20.

A plurality of coupling parts 302 may be provided in the ventilation part 300 to allow the ventilation part 300 secured to the cabinet 20.

The coupling parts 302 may be provided in a rear circumferential surface of the ventilation part 300 which contacts with the cabinet 10 and they may be configured of any types capable of allowing the ventilation part 300 secured to the cabinet 10 such as hooks and screws and the like.

The ventilation part 300 plays a role of a circulation passage configured to circulate internal air and external air of the tub 20 and it always has an open path.

Here, although it makes the inside and outside of the tub 20 in communication with each other, the ventilation part 300 is located in the cabinet 10, not in communication with an outside of the cabinet 10. Inner noise generated during the operation of the washing machine may not be diffused outside the washing machine 1 advantageously, because the ventilation part 300 is located in the cabinet 10.

Since the ventilation part 300 is the open path type, wash water or detergent bubbles might be exhausted outside the tub 20 via the ventilation part 300 during the operation of the washing machine 1. As a result, an end portion of the extended part toward the top of the cabinet 10 may be configured higher than a water level when the maximum amount of wash water is supplied to the tub 20.

If the end portion of the ventilation part 300 is formed higher than the highest water level of the tub 20, water leakage and detergent bubble exhaustion via the ventilation part 300 may be prevented without any auxiliary preventing structure.

The internal air of the tub 20 has a relatively higher temperature than the external air. Passing washing and rinsing processes using heated-water, a steam supplying process or a drying process, the temperature of the internal air of the tub 20 may be relatively higher than the temperature of the external air.

Here, the venting portion 120*a* is located in the upper portion of the tub 20 and thus the internal air of the tub 20 having the relatively higher temperature than the external air may move upward to the top of the tub 20. Because of that, the internal air of the tub 20 may be discharged outside of the tub 20 via the venting portion 120*a*.

In contrast, the external air of the tub 20 has the relatively lower temperature than the internal air and thus the external air of the tub 20 may be drawn into the tub 20 via the ventilation part 300.

That is, convection air current generated by temperature difference enables the internal air of the tub 20 to be exhausted to the top of the tub 20 and it enables the external air of the tub 20 to be drawn into the tub 20 via the ventilation part 300 installed in the lower portion of the tub 20. Such the convection air current is generated in the tub 20 and it results in improving air permeability.

As a result, even when the washing machine is not used, the air permeability may be secured and there may be an effect of preventing unpleasant smell generated by humidity.

In the meanwhile, a blocking member may be further provided just in case the ventilation part 300 is not high enough, or if the detergent bubbles and the like are discharged via the ventilation part 300 and the venting portion 120*a*. An example of the blocking member may be a check valve 320.

Figure 4:
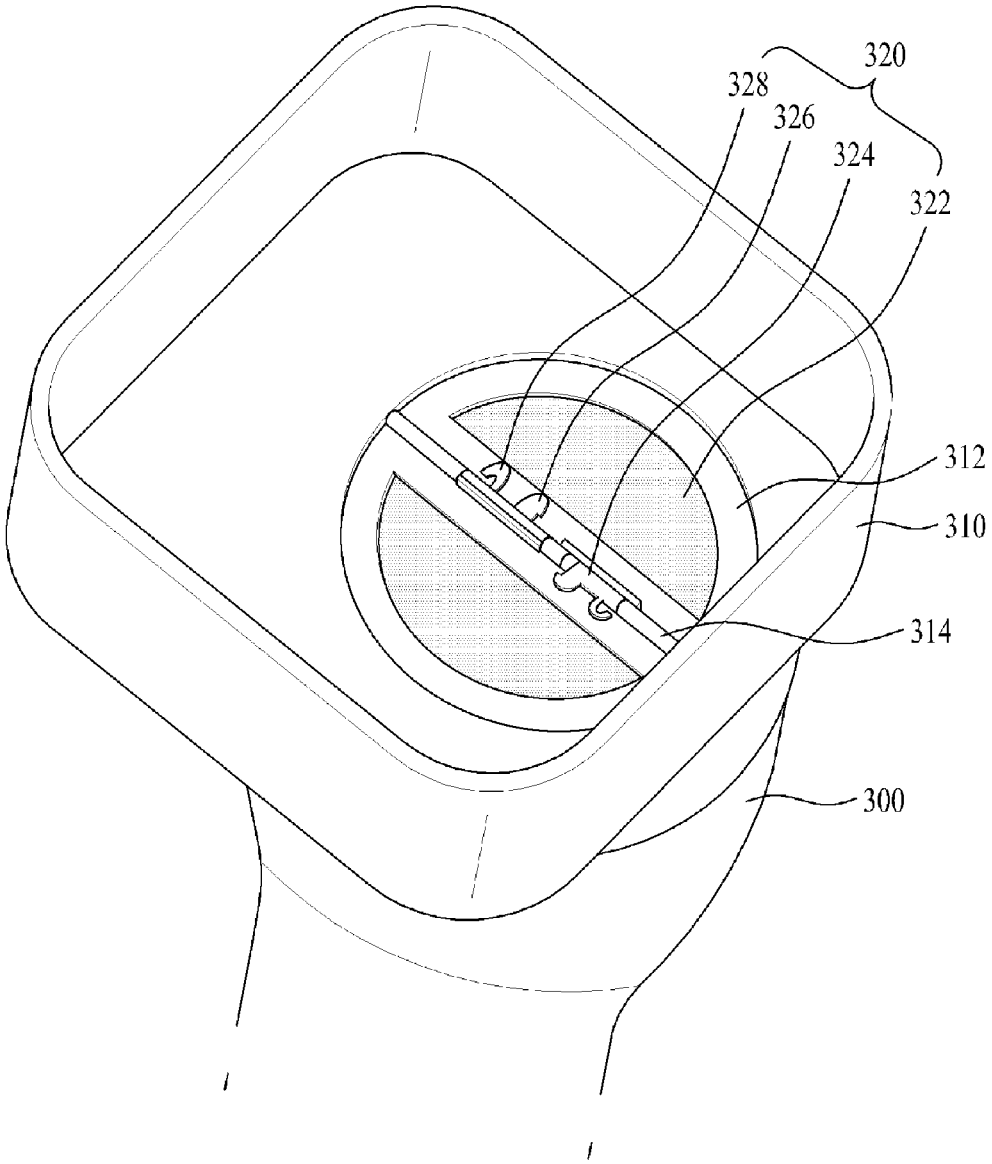
FIG. 4 is a perspective view illustrating a check-valve and a bubble-receiver according to an embodiment of the present invention.
Figure 5:
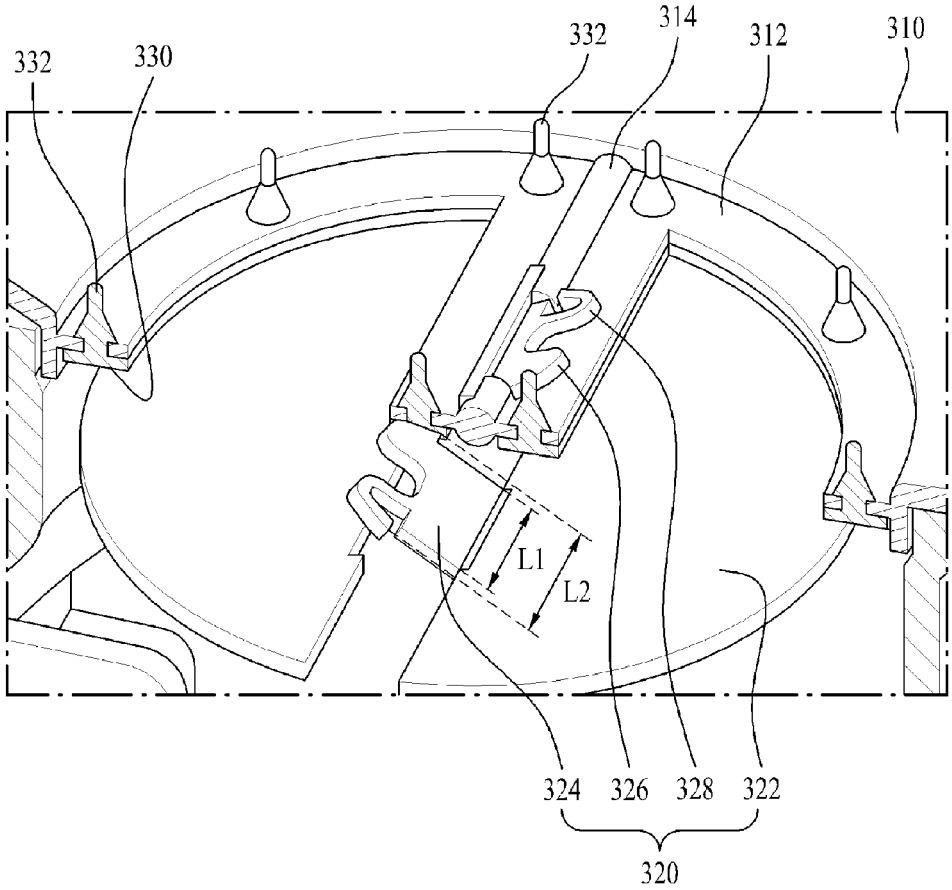
FIG. 5 is a sectional view partially illustrating the check-valve of FIG. 4 along A-A line.
Figure 6:
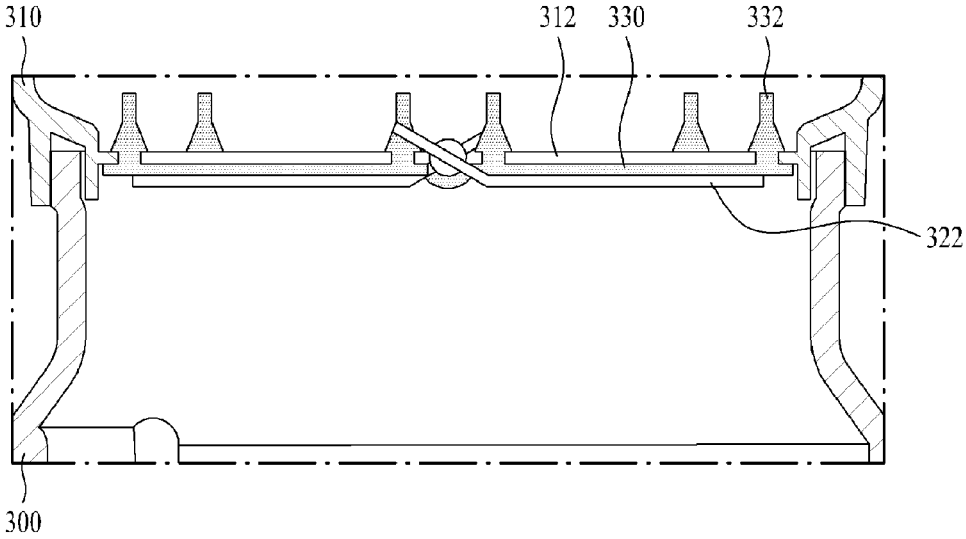
FIG. 6 is a sectional view illustrating the check-valve of FIG. 4 along A-A line.

As shown in FIGS. 4 to 6, the check valve 320 may be installed in an upper end of the ventilation part 300. Here, the identical check valve may be installed in the venting portion and the drawing shows only the check valve installed in the ventilation part.

As shown in FIG. 4, a check valve supporting part 312 is provided in the end of the ventilation part 300 and the check valve 320 may be installed in the check valve supporting part 312. The valve supporting part 312 includes a thin circular plate and a predetermined hole formed in the thin circular plate, corresponding to a flapper 322 which will be described later.

In addition, the valve supporting part 312 includes an inserting hole (not shown) configured to insert a flapper supporting part 324, which will be described later, therein and a flapper hooking part 314 having the flapper supporting supported thereto. The inserting hole and the flapper hooking part 314 are configured to across a center of the valve supporting part 312 in a line, which will be described in detail later. The flapper hooking part 314 is projected upward a predetermined distance from the center of the valve supporting part 314. As shown in FIGS. 5 and 6, the check valve 320 is a flapper type and it includes a flapper 322, a flapper supporting part 324, a hooking projection 326 and a flexible projection 328.

The flapper 322 is a thin plate shape and it is integrally formed with the flapper supporting part 314. At least two flappers 322 may be provided and the flapper 322 move downward because of it's self-weight to maintain an open state of the end of the ventilation part 300, when the washing machine is not used. The flapper 322 is rotated upward because of the increasing pressure generated when detergent bubbles move upward, only to close the upper end of the ventilation part 300.

The flapper 322 is located below the valve supporting part 312. because of that, when the flapper 322 moves upward, an upper surface of the flapper 322 contacts with an lower surface of the valve supporting part 312. The flapper 322 contacts with the valve supporting part 312 and the upper end of the ventilation part 300 is closed accordingly.

The flapper supporting part 324 is integrally formed with the flapper 322. An end of the flapper supporting part 324 is connected to the flapper 322 and the other end thereof includes the hooking projection 326 and the flexible projection 328.

An end of the hooking projection 326 may be a hook shape projected outward from the flapper supporting part 324 and the flexible projection 328 is projected distant from the hooking projection 326 at a predetermined space formed there between.

The flexible projection 328 is a ring shape and an end of the flexible projection 328 is projected outwardly from the flapper supporting part 324. Here, the projected portion of the flexible projection 328 may be elastically transformed.

The width (L2) of the hooking projection 326 and the flexible projections 328 may be predeterminedly larger than the width (L1) of the flapper supporting part 324. However, when the flexible projection 328 is pressed, the width (L2) of the hooking and flexible projections 326 and 328 may be identical to or predeterminedly smaller than the width (L1) of the flapper supporting part 324.

When the flapper is coupled with the flapper supporting part 324, the hooking projection 326 and the flexible projection 328 provided in the end of the flapper supporting part 324 may be inserted in the inserting hole formed in the valve supporting part 312. At this time, the inserting hole may be corresponding to or predeterminedly smaller than the width of the flapper supporting part 324.

When the hooking projection 326 and the flexible projection 328 are inserted in the inserting hole, the width (L2) of the projections may be larger than the width of the flapper supporting part 324 and the flexible projection 328 is pressed accordingly. When the flexible projection 328 is pressed to decrease the width (L2), the hooking projection 326 and the flexible projection 328 may pass through the inserting hole.

Once inserting in inserted in the inserting hole, the hooking projection 326 and the flexible projection 328 are projected upward outside of the valve supporting part 312. At this time, the force pressing the flexible projection 328 disappears and the flexible projection 328 is restituted. Once the flexible projection 328 is restituted, the width (L2) of the hooking projection 326 and the flexible projection 328 may be larger than the size of the inserting hole. Because of that, the hooking projection 326 and the flexible projection 328 may be hooked to the flapper hooking part 312 mentioned above.

When the flapper 322 is rotated in this state, the hooking projection 326 and the flexible projection 328 may be rotated, with supporting the flapper 322, beyond the inserting hole. The flapper supporting parts 324 may be provided for the flappers 322, respectively, to support the flappers 322.

If the flapper 322 is collided against the valve supporting part 312 during the operation, operational noise might be generated. As a result, a damper part 330 may be installed between contacting surfaces of the vale supporting part 312 and the flapper 322.

The damper part 330 may be installed on the inner circumferential surface of the ventilation part 300 corresponding to the operation area of the flapper 322 and the damper part 330 may be installed between contacting surfaces of the flapper 322 and valve supporting part 312.

The damper part 330 has a predetermined appearance corresponding to the appearance of the valve supporting part 312. That is, the damper part 330 is circular-thin-plate shaped, with a hole corresponding to the flapper 322.

The damper part 330 includes a plurality of coupling projections 332 configured to allow the damper part 330 coupled to the valve supporting part 312. For the coupling of the damper part 330, a plurality of though-holes (not shown) may be provided in the valve supporting part 312. The coupling projections 332 are projected upwardly to the valve supporting part 312 from the damper part 330. The coupling projections 332 are inserted in the through holes to couple the damper part 330 to the valve supporting part 312.

The damper part 330 may be made of elastic material including rubber, silicon, urethane and the like, to reduce the operational noise generated by the collision between the flapper 322 and the valve supporting part 312.

Figure 7:
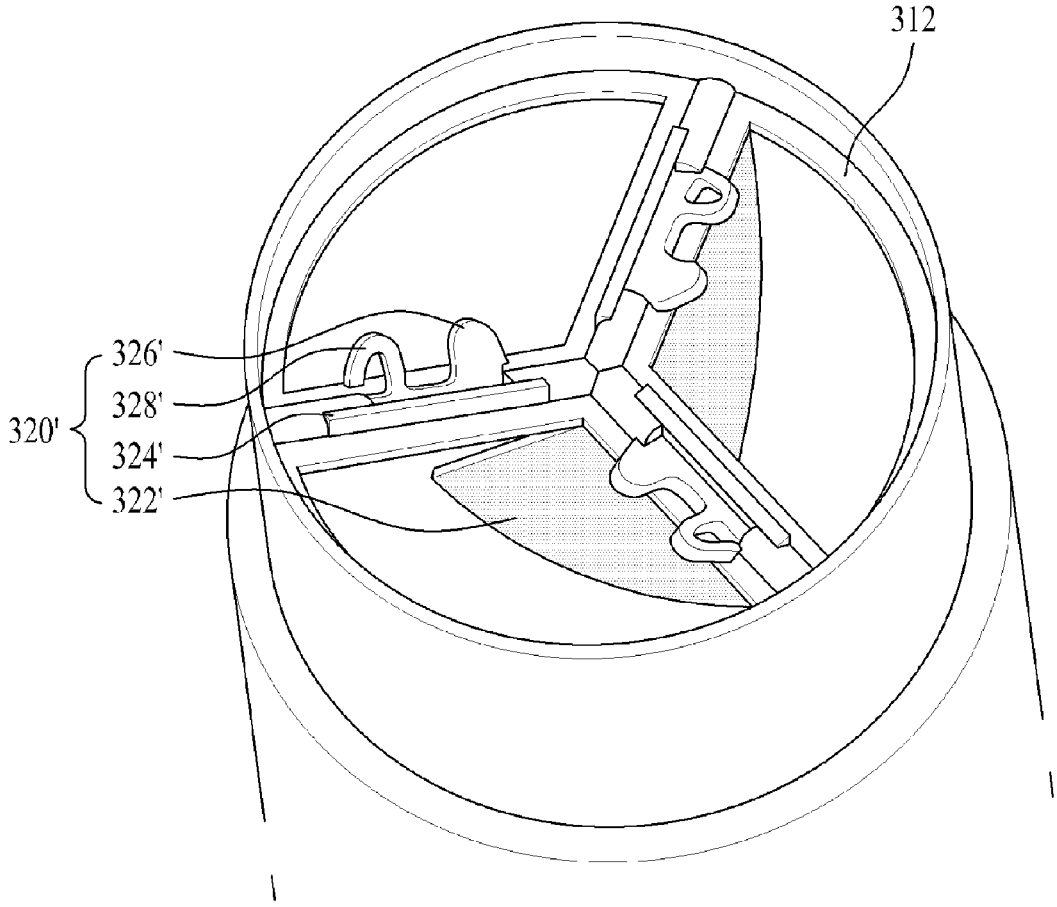
FIG. 7 is a perspective view illustrating a check-valve according to another embodiment of the present invention.

The above embodiment presents the check vale 320 having two flappers 332. According to another embodiment, a check valve 320' having three flappers 322' may be provided as shown in FIG. 7. In this case, a flapper supporting part 324', a hook projection 326' and a flexible projection 328' may be provided, identical to the above embodiment.

When the increase pressure is generated by the detergent bubbles during the operation of the washing machine, such the above configuration closes the ventilation part by using the check valve. When the washing machine is not used, the flappers of the check valve moves downward by their self weights and the ventilation part may be closed.

As a result, air permeability may be secured and the detergent bubbles are prevented from discharged from the tub simultaneously. If the detergent bubbles should be discharged, the detergent bubbles may be removed by using a bubble receiver, which will be described later.

As shown in FIG. 4, a bubble receiver 310 may be formed in the ventilation part 300 to receive and remove a small amount of detergent bubbles which overflow before the flappers 322 move upward to be closed.

The bubble receiver 310 may be formed in a circular rectangular shape having an open top and other various shapes. The bubble receiver 310 may be integrally formed with the ventilation part 300 or separably formed from the ventilation part 300.

With moved upward by the detergent bubbles, the check valve 320 contacts with the valve supporting part 312 and it is closed. Because of that, there will be a small amount of detergent even bubbles are discharged. As a result, if collected in the bubble receiver 310, the detergent bubbles contact the internal air of the cabinet 10 only to disappear.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a cabinet configured to define an exterior appearance thereof;

a tub installed in the cabinet to hold wash water therein;

a drum rotatably installed in the tub to accommodate laundry therein;

at least one venting portion provided in an upper portion of the tub to communicate with an outside of the tub; and a ventilation part provided in a lower portion of the tub to communicate with an inside of the tub, and wherein convection current of internal air of the tub generated via the venting portion and the ventilation part, wherein an end of the ventilation part is in communication with a rear lower portion of the tub and another end of the ventilation part is extended toward a top of the cabinet from the tub, and wherein the ventilation part is located in the cabinet, not in communication with an outside of the cabinet.

2. The washing machine as claimed in claim 1, wherein external air of the tub is drawn into the tub via the ventilation part, the external air of the tub having a relatively lower temperature than the internal air, and internal air of the tub is discharged out of the tub via the venting portion, the internal air of the tub having a relatively higher temperature than the external air.

3. The washing machine of claim 1, wherein the ventilation part has a pipe shape and a predetermined portion of the extended part of the ventilation is bent.

4. The washing machine of claim 1, wherein the ventilation part is one-sidedly in a rear portion of the tub.

5. The washing machine of claim 1, wherein an end portion of the ventilation part, which is extended toward an upper part of the cabinet, is higher than a predetermined water level measured when the maximum amount of the wash water is held in the tub.

6. The washing machine of claim 1, wherein the ventilation part comprises a plurality of coupling parts so that the ventilation part is coupled to the cabinet.

7. The washing machine of claim 1, wherein the venting portion or the ventilation part comprises a check valve.

8. The washing machine of claim 7, wherein the ventilation part comprises a valve supporting part so that the check valve is supported and installed therein.

9. The washing machine of claim 8, wherein the check valve comprises a flapper and a flapper supporting part is provided with the flapper as one body.

10. The washing machine of claim 9, wherein the flapper supporting part comprises a hooking projection hooked to the valve supporting part and a flexible projection spaced apart a predetermined distance from the hooking projection, the flexible projection elastically transformable.

11. The washing machine of claim 10, wherein the width (L2) between ends of the hooking projection and the flexible projection is larger than the width (L1) of the flapper.

12. The washing machine of claim 9, wherein the ventilation part further comprises a damper part so as to dampen an operational shock during the operation of the flapper.

13. The washing machine of claim 12, wherein the damper part is provided between contacting surfaces of the flapper and the valve supporting part.

14. The washing machine of claim 12, wherein the damper part comprises a plurality of coupling projections so that the damper part is coupled to the ventilation part.

15. The washing machine of claim 12, wherein the damper part is made of elastic material.

16. The washing machine of claim 7, wherein the ventilation part further comprises a bubble receiver which receives detergent bubbles discharged via the check valve.

17. The washing machine of claim 16, wherein the bubble receiver is integrally formed with or separable from an end of the ventilation part.

18. A washing machine comprising:

a cabinet configured to define an exterior appearance thereof;

a tub installed in the cabinet to hold wash water therein;

a drum rotatably installed in the tub to accommodate laundry therein;

at least one venting portion provided in an upper portion of the tub to communicate with an outside of the tub; and a ventilation part provided in a lower portion of the tub to communicate with an inside of the tub, and wherein convection current of internal air of the tub generated via the venting portion and the ventilation part, wherein the venting portion or the ventilation part comprises a check valve, wherein the ventilation part comprises a valve supporting part so that the check valve is supported and installed therein, wherein the check valve comprises a flapper and a flapper supporting part is provided with the flapper as one body, and wherein the flapper supporting part comprises a hooking projection hooked to the valve supporting part and a flexible projection spaced apart a predetermine distance from the hooking projection, the flexible projection elastically transformable.

19. A washing machine comprising:

a cabinet configured to define an exterior appearance thereof;

a tub installed in the cabinet to hold wash water therein;

a drum rotatably installed in the tub to accommodate laundry therein;

at least one venting portion provided in an upper portion of the tub to communicate with an outside of the tub; and a ventilation part provided in a lower portion of the tub to communicate with an inside of the tub, and wherein convection current of internal air of the tub generated via the venting portion and the ventilation part, wherein an end of the ventilation part is in communication with a rear lower portion of the tub and another end of the ventilation part is extended toward a top of the cabinet from the tub, and wherein the ventilation part is located in the cabinet and sealed from an outside of the cabinet.

* * * * *